US009640897B2

(12) United States Patent
Miyazaki et al.

(10) Patent No.: US 9,640,897 B2
(45) Date of Patent: May 2, 2017

(54) WIRE-SIDE CONNECTOR AND DEVICE-SIDE CONNECTOR WITH MATING GUIDES

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Katsushi Miyazaki, Mie (JP); Hiroyoshi Maesoba, Mie (JP); Ryoya Okamoto, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-Shi, Osaka (JP)

( * ) Notice: Subject to any disclaimer, the term of this patent is extended or adjusted under 35 U.S.C. 154(b) by 0 days.

(21) Appl. No.: 14/781,073

(22) PCT Filed: Mar. 20, 2014

(86) PCT No.: PCT/JP2014/057672
§ 371 (c)(1),
(2) Date: Sep. 29, 2015

(87) PCT Pub. No.: WO2014/162884
PCT Pub. Date: Oct. 9, 2014

(65) Prior Publication Data

US 2016/0308298 A1 Oct. 20, 2016

(30) Foreign Application Priority Data

Apr. 5, 2013 (JP) ..... 2013-079435

(51) Int. Cl.
*H01R 13/502* (2006.01)
*H01R 13/514* (2006.01)
*H01R 13/631* (2006.01)

(52) U.S. Cl.
CPC ..... *H01R 13/514* (2013.01); *H01R 13/631* (2013.01); *H01R 13/6315* (2013.01)

(58) Field of Classification Search
CPC ... H01R 13/514; H01R 13/516; H01R 13/518
(Continued)

(56) References Cited

U.S. PATENT DOCUMENTS 5,344,347 A * 9/1994 Inoue ..... H01R 13/193 439/701
5,855,486 A 1/1999 Fukamachi
2014/0024262 A1 1/2014 Okamoto et al.

FOREIGN PATENT DOCUMENTS

JP 7-32877 6/1995
JP 11-176517 7/1999
(Continued)

OTHER PUBLICATIONS

European Search Report Dated Feb. 10, 2016.
International Search Report.

*Primary Examiner* — Vanessa Girardi
(74) *Attorney, Agent, or Firm* — Gerald E. Hespos; Michael J. Porco; Matthew T. Hespos

(57) ABSTRACT

A connector (10) includes a device-side connector (30) and a wire-side connector (11). The device-side connector (30) includes a device-side receptacle group (35) formed by stacking a plurality of device-side receptacles (36) having an opening (36C) on a front side in a connecting direction. The wire-side connector (11) includes wire-side terminals (17), terminal accommodating portions (20) and an accommodation case (12) configured to hold the terminal accommodating portions (20) movably in a direction intersecting with the
(Continued)

connecting direction. The opening (36C) of an end device-side receptacle (36A) arranged on one end part includes a guiding protrusion (42) projecting in a stacking direction and configured to guide the corresponding terminal accommodating portion (20) in a proper connection posture into the end device-side receptacle (36A), whereas the accommodation case (12) includes a receiving portion (13) configured to receive the guiding protrusion (42).

4 Claims, 11 Drawing Sheets

(58) Field of Classification Search
USPC ..... 439/157, 378, 658, 701
See application file for complete search history.

(56) References Cited

FOREIGN PATENT DOCUMENTS

| | | | |
|---|---|---|---|
| JP | 2002313488 | A | 10/2002 |
| JP | 2003-338340 | | 11/2003 |
| JP | 2004327219 | A | 11/2004 |
| JP | 2007-242251 | | 9/2007 |
| JP | 2008-198429 | | 8/2008 |
| JP | 2012-226882 | | 11/2012 |

* cited by examiner

WIRE-SIDE CONNECTOR AND DEVICE-SIDE CONNECTOR WITH MATING GUIDES

BACKGROUND

1. Field of the Invention

The present invention relates to a connector.

2. Description of the Related Art

In the case of using a plurality of similarly configured devices side by side, these devices may be used while being stacked. In such a case, a plurality of connectors may also be stacked on the same side.

Connectors need to be connected in view of a stacking tolerance in stacking a plurality of connectors, but there has been a problem of being very difficult to connect connectors connected to devices (device-side connectors) in view of the stacking tolerance.

To solve such a problem, it has been proposed, for example, in Japanese Unexamined Patent Publication No. 2012-226882 that a manufacturing tolerance of a device side can be absorbed by providing a clearance between a plurality of terminal accommodating portions and an accommodation case for accommodating the terminal accommodating portions in a wire-side connector to be connected to a device-side connector and making the terminal accommodating portions movable relative to the accommodation case.

However, in a wire-side connector configured such that a plurality of terminal accommodating portions are movable relative to an accommodation case as described in the above patent literature 1, the terminal accommodating portions may be inclined without taking a proper connection posture when the wire-side connector is connected to a device-side connector.

If an attempt is made to connect the wire-side connector including the terminal accommodating portions in an inclined state and the device-side connector, the terminal accommodating portions and receptacles of the device-side connector interfere and a connecting operation cannot be performed. In such a case, the terminal accommodating portions and the corresponding device-side receptacles need to be positioned prior to the connecting operation, which has presented a problem of poor operation efficiency.

The present invention was completed based on the above situation and aims to improve operation efficiency in connecting a device-side connector and a wire-side connector.

SUMMARY

To improve the efficiency of a connecting operation of a device-side connector and a wire-side connector, it is considered to avoid the interference between device-side receptacles and terminal accommodating portions by making the device-side receptacles larger. In this case, there has been a problem of enlarging the device-side receptacles since the size of the device-side receptacles needs to be set in consideration of the inclination of the terminal accommodating portions. If the device-side receptacles are enlarged, an accommodation case of the wire-side connector for receiving the device-side receptacles needs to be enlarged.

The present invention was achieved as a result of intensive studies on a configuration for improving the efficiency of a connecting operation while suppressing the enlargement of device-side receptacles.

Specifically, the present invention is directed to a connector with a device-side connector provided on a device side and a wire-side connector provided on a wire side and to be connected to the device-side connector, wherein the device-side connector includes a device-side receptacle group formed by stacking a plurality of device-side receptacles having an opening on a front side in a connecting direction, the wire-side connector includes a plurality of wire-side terminals, a plurality of terminal accommodating portions configured to respectively accommodate the wire-side terminals and to be individually accommodated into the device-side receptacles when the device-side connector and the wire-side connector are connected, and an accommodation case configured to hold the plurality of terminal accommodating portions movably in a direction intersecting with the connecting direction, and the opening of an end device-side receptacle arranged on one end part out of the plurality of device-side receptacles includes a guiding protrusion receptacles projecting in a stacking direction and configured to guide the corresponding terminal accommodating portion in a proper connection posture into the end device-side receptacle, whereas the accommodation case includes a receiving portion configured to receive the guiding protrusion.

In the present invention, the opening of the end device-side receptacle arranged on the one end part includes the guiding protrusion projecting in the stacking direction and configured to guide the corresponding terminal accommodating portion in the proper connection posture into the end device-side receptacle, whereas the accommodation case includes the receiving portion configured to receive the guiding protrusion.

Accordingly, in the present invention, the corresponding terminal accommodating portion is guided into the end device-side receptacle while being corrected into the proper connection posture by the guiding protrusion provided on the opening of the end device-side receptacle even if the terminal accommodating portion is inclined in a direction intersecting with the connecting direction.

Further, since the device-side receptacles are enlarged only by a projecting dimension of the guiding protrusion in the present invention, enlargement can be suppressed more than in the case of considering the inclination of the terminal accommodating portions. As a result, according to the present invention, operation efficiency in connecting the device-side connector and the wire-side connector can be improved more than before while the enlargement of the device-side receptacles is suppressed.

The present invention may be configured as follows.

The end device-side receptacle may include a guide groove configured to guide the terminal accommodating portion guided by the guiding protrusion into the device-side receptacle, whereas the corresponding terminal accommodating portion may include a guide protrusion formed to project in an outward direction from a wall portion constituting the terminal accommodating portion and to be guided by the guide groove of the end device-side receptacle.

If such a configuration is adopted, the guide protrusion of the terminal accommodating portion is guided into the device-side receptacle by the guide groove of the end device-side receptacle after the terminal accommodating portion corresponding to the end device-side receptacle is corrected into the proper connection posture by the guiding protrusion of the end device-side receptacle, wherefore operation efficiency in connection can be reliably improved.

Each of the plurality of device-side receptacles may include a guiding portion configured to guide the terminal accommodating portion in a proper connection posture into the corresponding device-side receptacle, whereas each of the plurality of terminal accommodating portions may include a guided portion to be guided by the guiding portion of the device-side receptacle.

If such a configuration is adopted, not only the terminal accommodating portion corresponding to the end device-side receptacle, but also the other terminal accommodating portions are guided into the device-side receptacles while being corrected into the proper connection posture. Therefore, operation efficiency in connecting the device-side connector and the wire-side connector can be further improved.

According to the present invention, it is possible to improve operation efficiency in connecting a device-side connector and a wire-side connector.

DETAILED DESCRIPTION

One embodiment of the present invention is described with reference to FIGS. 1 to 11. As shown in FIG. 6, a connector 10 of this embodiment includes a wire-side connector 11 and a device-side connector 30 connectable to each other. The device-side connector 30 is a connector provided on a device-side where flat devices such as batteries and substrates are stacked. On the other hand, the wire-side connector 11 is a connector connected to ends of wires W such as a voltage detection line and a power line. Note that, in the following description, a connecting direction of the both connectors 11, 30 is referred to as a front-back direction and connection surface sides thereof are referred to as front sides.

Figure 3:
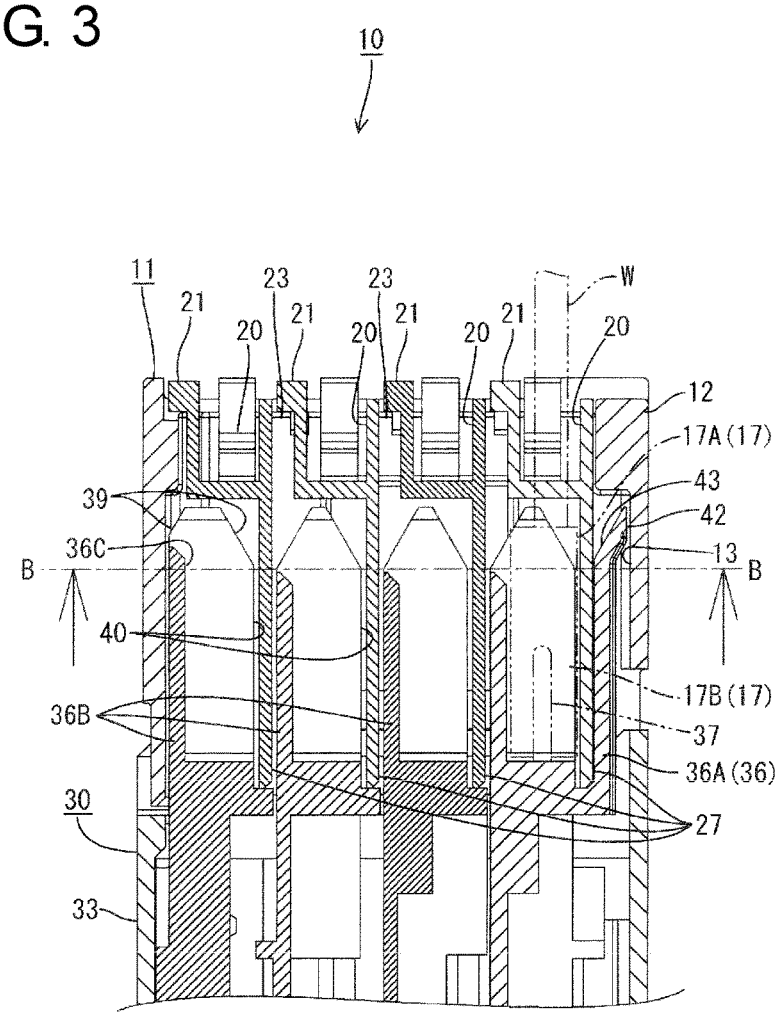
FIG. 3 is a section along A-A of FIG. 2.

As shown in FIG. 3, the wire-side connector 11 includes four (plural) terminal accommodating portions 20, wire-side terminals 17 accommodated in the respective terminal accommodating portions 20 and an accommodation case 12 for accommodating the plurality of terminal accommodating portions 20.

The wire-side terminal 17 includes a wire connecting portion 17A to be connected to an end of the wire W and a terminal connecting portion 17B to be connected to a device-side terminal 37. Although not shown in detail, the terminal connecting portion 17B is in the form of a rectangular tube with open front and rear ends and a resilient contact piece is formed inside. The device-side terminal 37 is insertable into an opening on the front end of the terminal connecting portion 17B and the resilient contact piece is deflected and deformed to resiliently come into contact with the device-side terminal 37, whereby the both terminals 17, 37 are electrically conductively connected.

Figure 1:
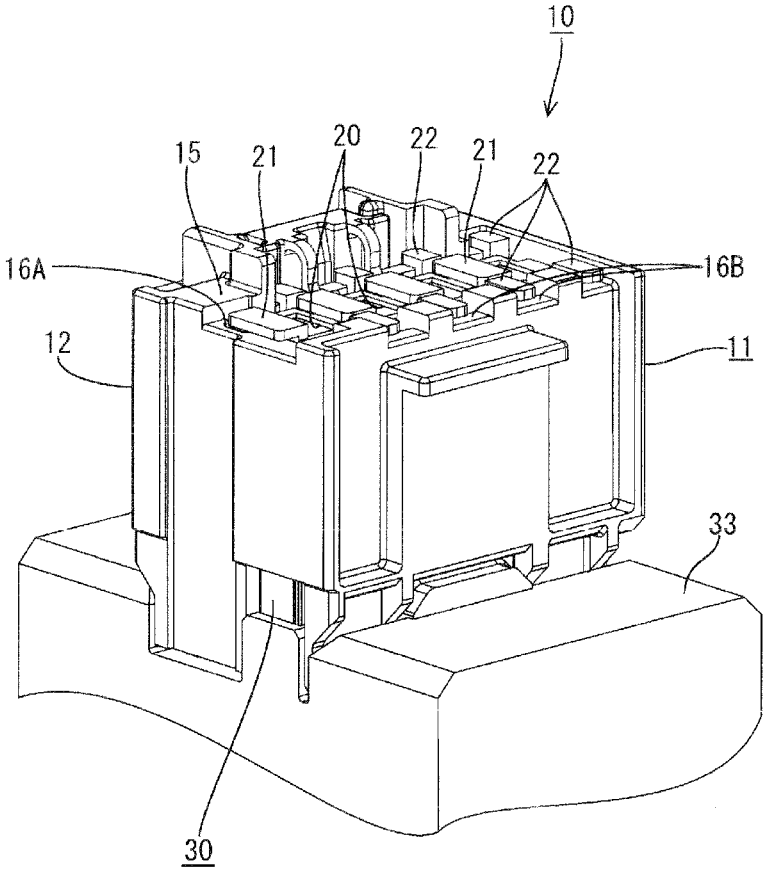
FIG. 1 is a perspective view of a connector according to an embodiment.
Figure 2:
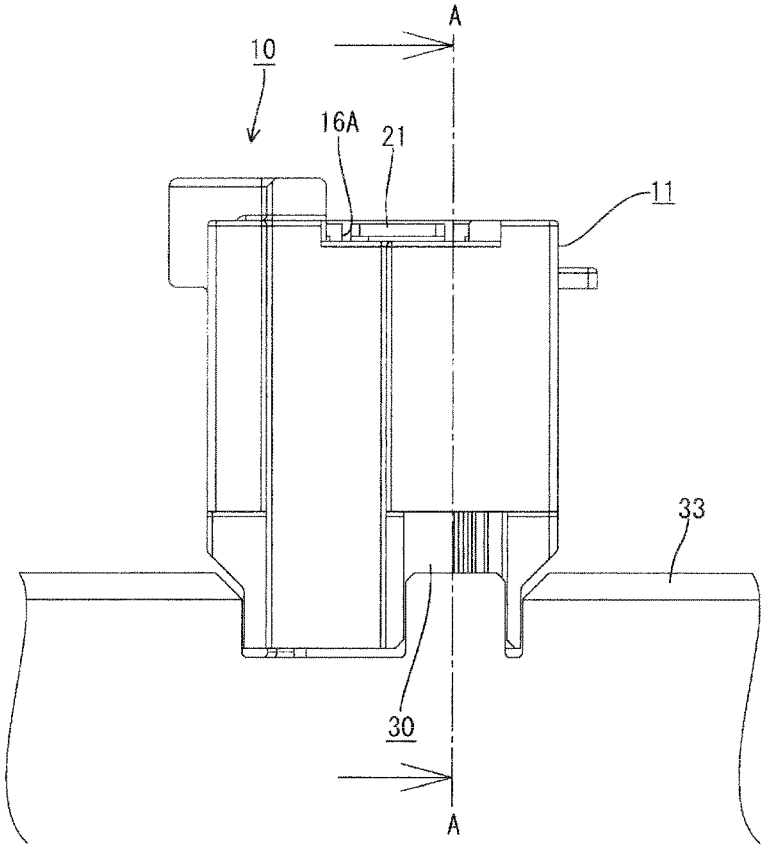
FIG. 2 is a side view of the connector.
Figure 7:
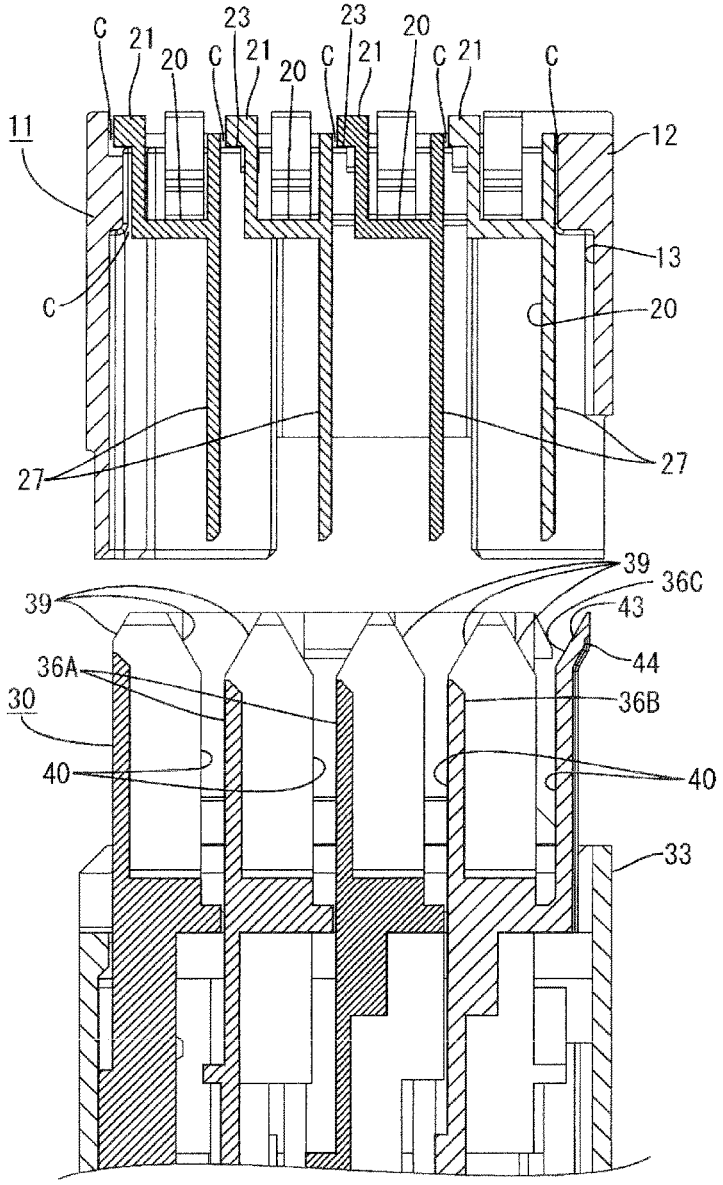
FIG. 7 is a section in a state of FIG. 6.

A front side of the accommodation case 12 is open as shown in FIG. 7, and holding recesses 16A, 16B capable of holding the plurality of terminal accommodating portions 20 side by side are provided on edge parts of a back wall 15 of the accommodation case 12 as shown in FIG. 1.

A first holding recess 16A formed on a left edge part of FIG. 1 is shaped to be able to receive a holding piece 21 of the terminal accommodating portion 20 arranged on a left side in FIG. 1.

Second holding recesses 16B formed on a pair of side edge parts extending along an arrangement direction of the terminal accommodating portions 20 (lateral direction of FIG. 1) out of the edge parts of the back wall 15 of the accommodation case 12 are shaped to be able to receive holding arms 22 of the terminal accommodating portions 20.

Figure 4:
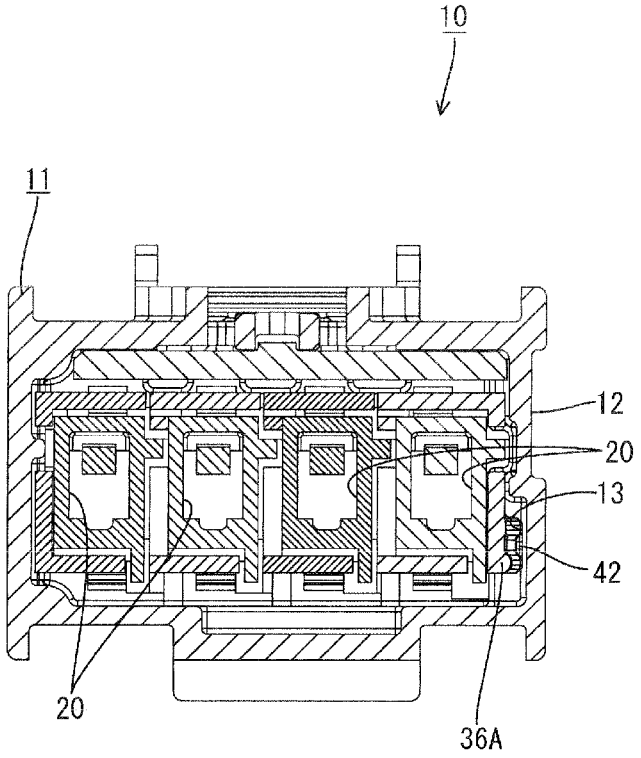
FIG. 4 is a section along B-B of FIG. 3.

As shown in FIGS. 3 and 4, a receiving portion 13 for receiving a guiding protrusion 42 of a device-side receptacle 36A on one end part to be described later is provided inside the accommodation case 12. Note that, in FIGS. 5, 8 and 11, a state where a wall on a front surface side of the accommodation case 12 and a wall covering a front surface side of a device-side receptacle group 35 (wall on a front surface side of the device-side connector 30) out of a device-side covering portion 33A are removed is shown to make conditions of the terminal accommodating portions 20 and the device-side receptacles 36 comprehensive. Note that, in this embodiment, the device-side receptacle 36A on one end part and the other device-side receptacles 36B are referred to as an "end device-side receptacle 36A" and "other device-side receptacles 36B" when they are distinguished.

As shown in FIG. 7, the plurality of terminal accommodating portions 20 are held in the accommodation case 12 in a state movable in a direction (stacking direction in this embodiment) intersecting with a connecting direction (vertical direction of FIG. 7). Clearances C are provided between adjacent terminal accommodating portions 20 and between the terminal accommodating portions 20 and the accommodation case 12 as shown in FIG. 7, whereby each terminal accommodating portion 20 is movable in the direction intersecting with the connecting direction. The terminal accommodating portions 20 move in the direction intersecting with the connecting direction, whereby a stacking tolerance in the device-side connector 30 is absorbed.

Each terminal accommodating portion 20 is formed to project forward from the back wall 15. As shown in FIG. 3, the wire-side terminal 17 can be accommodated into the terminal accommodating portion 20. When the wire-side terminal 17 is inserted into the terminal accommodating portion 20, a locking lance (not shown) provided in the terminal accommodating portion 20 is fitted into a lance hole (not shown) provided on the wire-side terminal 17 to retain the wire-side terminal 17.

The holding piece 21 projecting outwardly is formed on a left edge of a rear end part of each terminal accommodating portion 20 in FIG. 6. A holding piece receiving portion 23 capable of receiving the holding piece 21 of the adjacent terminal accommodating portion 20 is formed on a right edge of the rear end part of each terminal accommodating portion 20 in FIG. 6, and a pair of holding arms 22 to be received into the holding recesses 16B are formed to project in a direction substantially perpendicular to the arrangement direction of the terminal accommodating portions 20 from opposite sides of the holding piece receiving portion 23.

Figure 8:
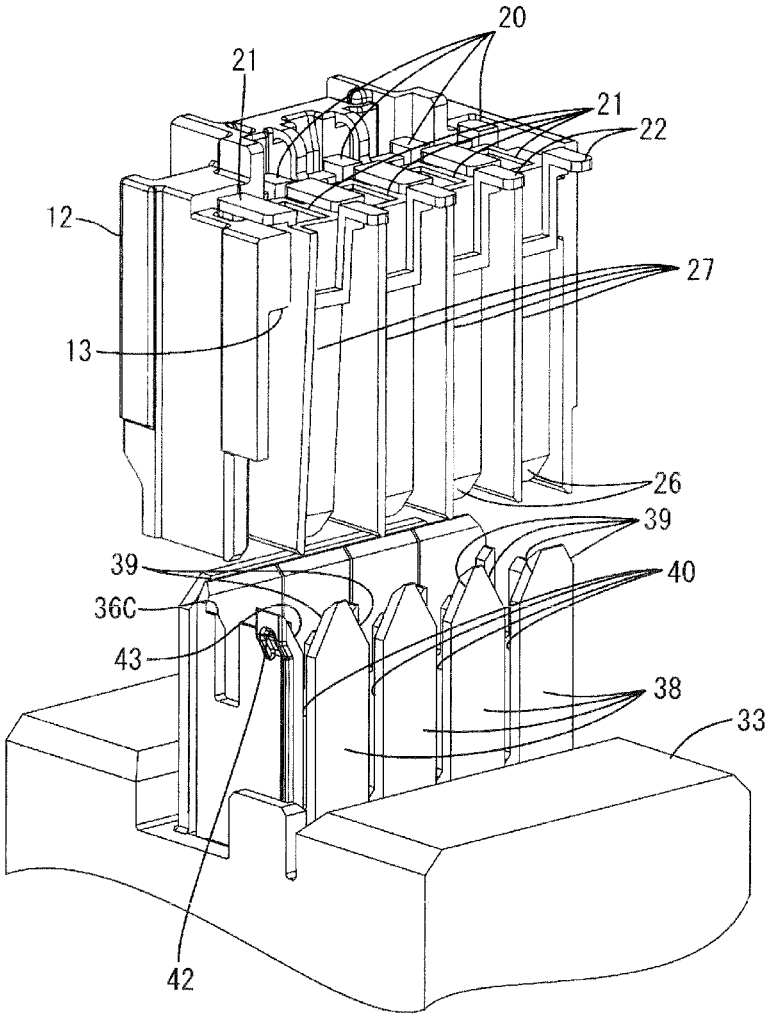
FIG. 8 is a perspective view of the device-side connector and the wire-side connector in the separated state showing the state where the wall on the front surface side of the accommodation case and the wall on the front surface side of the device-side connector are removed.

A tapered inclined surface 26 is formed on a front end part of the terminal accommodating portion 20 as shown in FIG. 8 and the terminal accommodating portion 20 is smoothly insertable into the device-side receptacle 36 during connection to the device-side connector 30.

A guide protrusion 27 (example of a guided portion) protruding outwardly in a width direction is provided on a side wall 20A arranged on a front side shown in FIG. 8 out of wall portions constituting the terminal accommodating portion 20. Although described in detail later, the terminal accommodating portion 20 is guided to take a proper connection posture by the contact of the guide protrusion 27 with an inclined surface 43 of the guiding protrusion 42 of the end device-side receptacle 36A or an inclined surface 39 (example of a guiding portion) of the other device-side receptacle 36B and the terminal accommodating portion 20 is fitted and guided by the insertion of the guide protrusion 27 into a guide groove 40 (example of the guiding portion) of the device-side receptacle 36.

The plurality of terminal accommodating portions 20 are successively accommodated into the accommodation case 12 from a left side of FIG. 8. First, the terminal accommodating portion 20 arranged on the left end is inserted downwardly from above in FIG. 8 in a state where the holding piece 21 thereof is positioned to correspond to the first holding recess 16A of the accommodation case 12 and the holding arms 22 are positioned to correspond to the second holding recesses 16B.

Subsequently, the second terminal accommodating portion 20 and the third terminal accommodating portion 20 from left are successively inserted. The second terminal accommodating portion 20 and the third terminal accommodating portion 20 from left are inserted downwardly from above in FIG. 8 in a state where the holding pieces 21 thereof are positioned to correspond to the holding piece receiving portions 23 of the adjacent terminal accommodating portions 20 and the holding arms 22 are positioned to correspond to the second holding recesses 16B.

Finally, when the terminal accommodating portion 20 on the right end is inserted downwardly from above in FIG. 8 in a state where the holding piece 21 thereof is positioned to correspond to the holding piece receiving portion 23 of the adjacent terminal accommodating portion 20 and the holding arms 22 are positioned to correspond to the second holding recesses 16B, an accommodating operation of the terminal accommodating portions 20 is completed.

The device-side connector 30 is composed of a plurality of split connectors 32 provided for each device. The plurality of split connectors 32 are collectively covered in a stacked state by a device-side case 33. A part of the device-side case 33 covering the device-side receptacle group 35 serves as the device-side covering portion 33A.

Each split connector 32 includes the device-side receptacle 36 and the device-side terminal 37 (see FIG. 3). In this embodiment, a plurality of stacked device-side receptacles 36 of the split connectors 32 are referred to as the device-side receptacle group 35. The device-side terminal 37 is provided to project forward from a back wall of the device-side receptacle 36.

Two inclined surfaces 39 are respectively formed on a shown upper end of a wall 38 arranged on a front surface side of each of four (plural) device-side receptacles 36 to have a tapered upper end side (front end side in the connecting direction) as shown in FIG. 8. Further, the wall 38 arranged on the front surface side of each device-side receptacle 36 is formed with a slit-like guide groove 40 connected to one inclined surface 39 and extending in the connecting direction. The guide protrusion 27 of the terminal accommodating portion 20 is fitted into the guide groove 40 to fit and guide the terminal accommodating portion 20 into the device-side receptacle 36.

Figure 5:
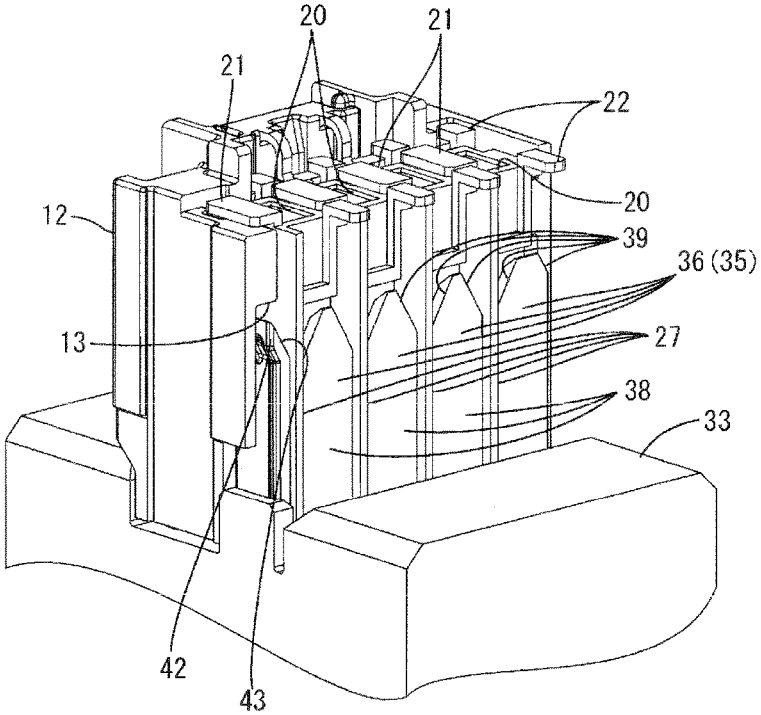
FIG. 5 is a perspective view of the connector showing a state where a wall on a front surface side of an accommodation case and a wall on a front surface side of a device-side connector are removed.
Figure 6:
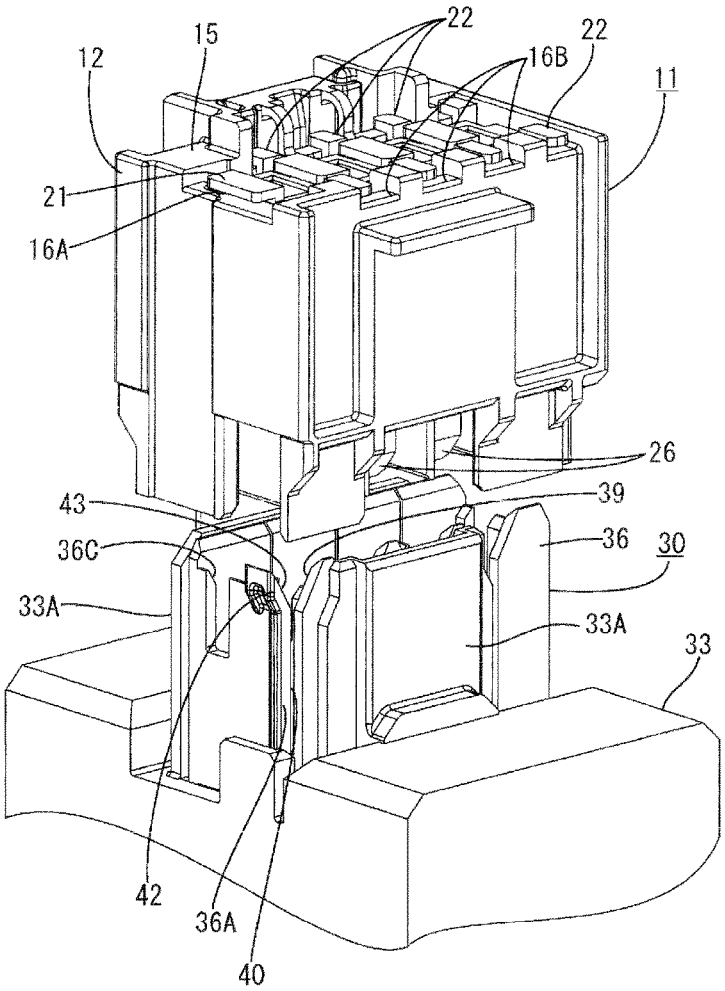
FIG. 6 is a perspective view of the device-side connector and a wire-side connector in a separated state.
Figure 9:
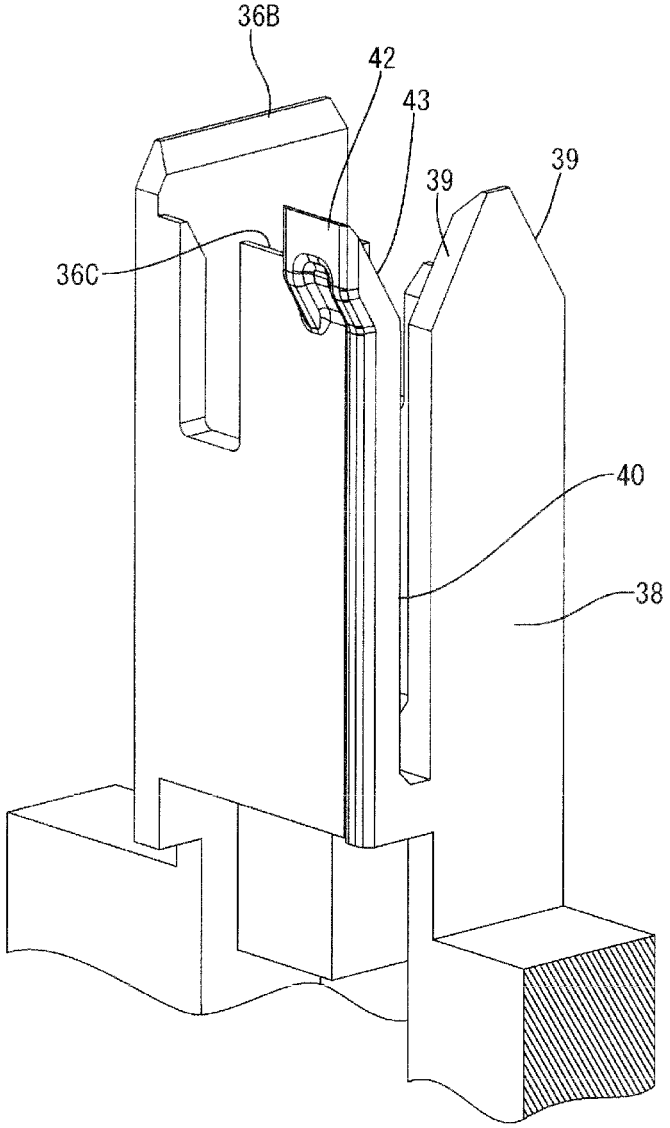
FIG. 9 is a perspective view of an end device-side receptacle.
Figure 10:
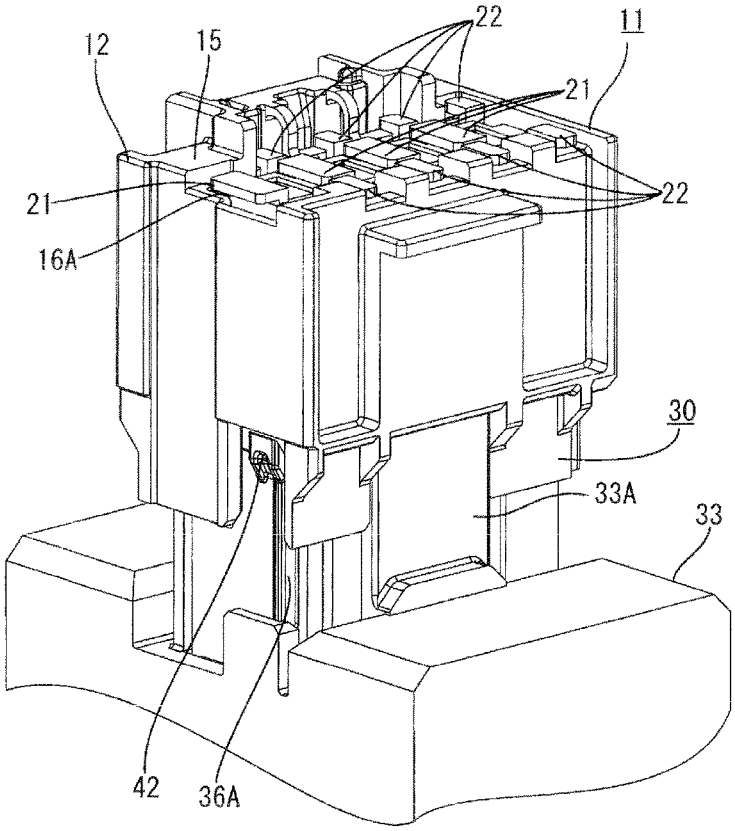
FIG. 10 is a perspective view of the connector during a connecting operation.
Figure 11:
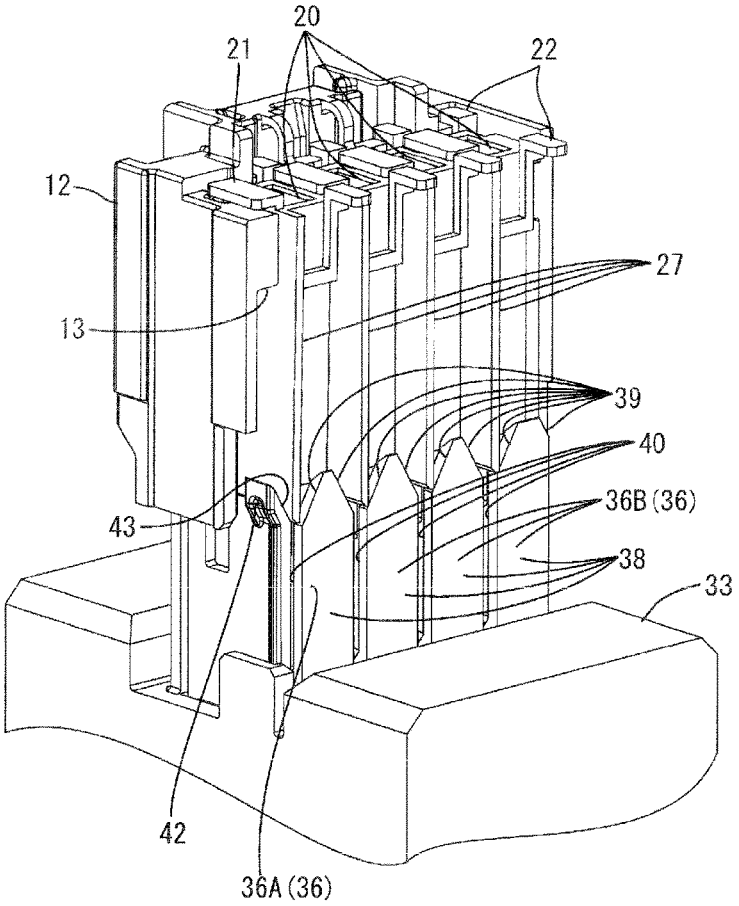
FIG. 11 is a perspective view of the connector during the connecting operation showing the state where the wall on the front surface side of the accommodation case and the wall on the front surface side of the device-side connector are removed

As shown in FIGS. 5 and 9, the guiding protrusion 42 is provided on the end device-side receptacle 36A arranged on the left end part shown in FIG. 5. As shown in FIG. 3, the guiding protrusion 42 is formed to project in the stacking direction (lateral direction as shown) in an opening 36C of the end device-side receptacle 36A and has a function of guiding the corresponding terminal accommodating portion 20 (terminal accommodating portion 20 on the left end in FIG. 5) in the proper connection posture into the end device-side receptacle 36A. Although the guiding protrusion 42 projects in the stacking direction as shown in FIG. 3, it is accommodated into the receiving portion 13 of the accommodation case 12.

The guiding protrusion 42 is formed with the inclined surface 43 inclined in a direction to enlarge the opening 36C toward the upper end of the opening 36C as shown in FIG. 3. The terminal accommodating portion 20 arranged on the end part is corrected into the proper connection posture by making a sliding movement after the guide protrusion 27 of this terminal accommodating portion 20 comes into contact with the inclined surface 43 of the guiding protrusion 42. Since the guide groove 40 is provided to be connected to the inclined surface 43 of the guiding protrusion 42 in this embodiment, the guide protrusion 27 of the terminal accommodating portion 20 corrected into the proper connection posture by the inclined surface 43 of the guiding protrusion 42 is fitted into the guide groove 40 and the terminal accommodating portion 20 is fitted and guided into the end device-side receptacle 36A.

Next, how to assemble the connector 10 of this embodiment is described. The wire-side connector 11 is prepared by accommodating the wire-side terminals 17 connected to the wires W into the terminal accommodating portions 20 after the four terminal accommodating portions 20 are successively accommodated into the accommodation case 12 from the end.

Simultaneously or before or after the assembling of the wire-side connector 11, the four split connectors 32 constituting the device-side connector 30 are stacked to prepare the device-side connector 30 in the stacked state. The device-side case 33 is mounted on the device-side connector 30 in the stacked state prepared in this way.

Subsequently, the device-side connector 30 and the wire-side connector 11 are connected. If the terminal accommodating portions 20 of the wire-side connector 11 are in the proper connection posture, the wire-side connector 11 and the device-side connector 30 can be smoothly connected without requiring positioning and the like.

Since the plurality of terminal accommodating portions 20 are held in the accommodation case 12 in the state movable in the direction (stacking direction) intersecting with the connecting direction in this embodiment, the terminal accommodating portions 20 of the wire-side connector 11 may be, for example, postured to be inclined rightwardly in FIG. 7. If the wire-side connector 11 and the device-side connector 30 are connected in such a case, the guide protrusion 27 of the terminal accommodating portion 20 arranged on the end part comes into contact with the guiding protrusion 42 of the end device-side receptacle 36A and the guide protrusions 27 of the other terminal accommodating portions 20 come into contact with end parts of the openings 36C of the other device-side receptacles 36B (see FIG. 11).

The guide protrusion 27 of the terminal accommodating portion 20 brought into contact with the guiding protrusion 42 of the end device-side receptacle 36A is guided by the inclined surface 43 of the guiding protrusion 42, whereby the terminal accommodating portion 20 is corrected into the proper connection posture. The guide protrusion 27 of each terminal accommodating portion 20 brought into contact with the end part (shown upper end part) of the opening 36C of the other device-side receptacle 36B is guided by the inclined surface 39 formed on the opening 36C of the other device-side receptacle 36B, whereby each terminal accommodating portion 20 is corrected into the proper connection posture.

When being fitted into the guide groove 40 from the inclined surfaces 43, 39, the guide protrusion 27 of each terminal accommodating portion 20 smoothly moves along the guide groove 40 (along the connecting direction), whereby the wire-side connector 11 is guided to be connected. When the wire-side connector 11 and the device-side connector 30 are properly connected as shown in FIGS. 1 and 5, the wire-side terminals 17 and the device-side terminals 37 are in a state electrically connectable to each other. At this time, the guiding protrusion 42 provided on the end device-side receptacle 36A is received into the receiving portion 13 of the accommodation case 12 (see FIG. 3).

In this embodiment, the opening 36*c* of the end device-side receptacle 36A arranged on the one end part is provided with the guiding protrusion 42 projecting in the stacking direction and configured to guide the corresponding terminal accommodating portion 20 in the proper connection posture into the end device-side receptacle 36A, whereas the accommodation case 12 is provided with the receiving portion 13 configured to receive the guiding protrusion 42.

Accordingly, in this embodiment, the corresponding terminal accommodating portion 20 is guided into the end device-side receptacle 36A while being corrected into the proper connection posture by the guiding protrusion 42 provided on the opening 36C of the end device-side receptacle 36A, for example, even if the terminal accommodating portion 20 is inclined in the stacking direction.

Particularly in this embodiment, since the guiding protrusion 42 is provided only on one end device-side receptacle 36A, the device-side receptacles 36 are enlarged only by a projecting dimension of the guiding protrusion 42 and the enlargement of the device-side receptacles 36 can be suppressed more than in the case of considering the inclination of the terminal accommodating portions 20. As a result, according to this embodiment, operation efficiency in connecting the device-side connector 30 and the wire-side connector 11 can be improved more than before while the enlargement of the device-side receptacles 36A, 36B is suppressed.

Further, in this embodiment, the end device-side receptacle 36A is provided with the guide groove 40 configured to guide the terminal accommodating portion 20 guided by the guiding protrusion 42 into the end device-side receptacle 36A, whereas the corresponding terminal accommodating portion 20 is provided with the guide protrusion 27 formed to project in an outward direction from the wall portion constituting the terminal accommodating portion 20 and to be guided by the guide groove 40 of the end device-side receptacle 36A.

Thus, according to this embodiment, the guide protrusion 27 of the terminal accommodating portion 20 is guided into the device-side receptacle 36A by the guide groove 40 of the end device-side receptacle 36A after the terminal accommodating portion 20 corresponding to the end device-side receptacle 36A is corrected into the proper connection posture by the guiding protrusion 42 of the end device-side receptacle 36A, wherefore operation efficiency in connection can be reliably improved.

Further, in this embodiment, each device-side receptacle 36 is provided with the inclined surfaces 39 and the guide groove 40 (guiding portion) for guiding the terminal accommodating portion 20 in the proper connection posture into the corresponding device-side receptacle 36, whereas each terminal accommodating portion 20 is provided with the guide protrusion 27 to be guided by the inclined surfaces 39 and the guide groove 40 of the device-side receptacle 36.

Thus, according to this embodiment, not only the terminal accommodating portion 20 corresponding to the end device-side receptacle 36A, but also the other terminal accommodating portions 20 are guided into the device-side receptacles 36 while being corrected into the proper connection posture. Therefore, operation efficiency in connecting the device-side connector 30 and the wire-side connector 11 can be further improved.

The present invention is not limited to the above described and illustrated embodiment. For example, the following embodiments are also included in the technical scope of the present invention.

In the above embodiment, the end device-side receptacle 36A is provided with the guide groove 40 for guiding the terminal accommodating portion 20 guided by the guiding protrusion 42 into the end device-side receptacle 36A, whereas the corresponding terminal accommodating portion 20 is provided with the guide protrusion 27 projecting in the outward direction from the wall portion constituting the terminal accommodating portion 20 and to be guided by the guide groove 40 of the end device-side receptacle 36A. However, there is no limitation to this.

The end device-side receptacle may be formed with no guide groove and the terminal accommodating portion may be formed with no guide protrusion.

In the above embodiment, the guiding portion (inclined surfaces 39, guide groove 40) is provided on the device-side receptacle 36, whereas the guided portion (guide protrusion 27) is provided on the wall portion 20A constituting the terminal accommodating portion 20. However, the guiding portion may be provided on the terminal accommodating portion and the guided portion may be provided on the device-side receptacle.

In the above embodiment, the guiding portion is composed of the two inclined surfaces 39 formed to taper the front end side in the connecting direction in the opening 36C of each device-side receptacle 36 and the guide groove 40 connected to one inclined surface 39 and configured to guide the terminal accommodating portion 20 into the device-side receptacle 36 by receiving the guide protrusion 27. However, the present invention is not limited to this. For example, the guiding portion may be composed only of one inclined surface.

Although all the device-side receptacles 36 are provided with the guiding portion and all the terminal accommodating portions 20 are provided with the guided portion in the above embodiment, some of the device-side receptacles may be provided with the guiding portion and some corresponding terminal accommodating portions may be provided with the guided portion.

Although the device-side connector 30 formed by stacking four split connectors 32 is described in the above embodiment, the number of the split connectors may be two, three, five or more.

LIST OF REFERENCE SIGNS

11 . . . wire-side connector
12 . . . accommodation case
13 . . . receiving portion
17 . . . wire-side terminal
20 . . . terminal accommodating portion
27 . . . guide protrusion (guided portion)
30 . . . device-side connector
32 . . . split connector
35 . . . device-side receptacle group
36 . . . device-side receptacle
36A . . . end device-side receptacle
36B . . . device-side receptacle other than end device-side receptacle
36C . . . opening
37 . . . device-side terminal
39 . . . inclined surface (guiding portion)
40 . . . guide groove (guiding portion)
42 . . . guiding protrusion
43 . . . inclined surface
C . . . clearance
W . . . wire

The invention claimed is:

1. A connector, comprising a device-side connector provided on a device side and a wire-side connector provided on a wire side and to be connected to the device-side connector, wherein:

the device-side connector is connectable to the wire side connector along a connecting direction and includes a device-side receptacle group formed by stacking a plurality of device-side receptacles in a stacking direction that is perpendicular to the connecting direction, the device-side connector having an opening on a front side in the connecting direction;

the wire-side connector includes a plurality of wire-side terminals, a plurality of terminal accommodating portions configured to respectively accommodate the wire-side terminals and to be individually accommodated into the device-side receptacles when the device-side connector and the wire-side connector are connected, and an accommodation case configured to hold the plurality of terminal accommodating portions movably in the stacking direction;

the opening of an end device-side receptacle arranged on one end part out of the plurality of device-side receptacles includes a guiding protrusion projecting in the stacking direction and the accommodation case includes a receiving portion configured to receive the guiding protrusion, the guiding protrusion and the receiving portion being configured to guide the corresponding terminal accommodating portion in a proper connection posture into the end device-side receptacle; and the guiding protrusion of the end device-side receptacle includes an inclined surface that is inclined relative to the connecting direction and that leads into a guide groove extending in the connecting direction and configured to guide the terminal accommodating portion guided by the guiding protrusion into the device-side receptacle, whereas the corresponding terminal accommodating portion includes a guide protrusion projecting from a wall of the terminal accommodating portion and to be guided by the guide groove of the end device-side receptacle.

2. A connector, comprising a device-side connector provided on a device side and a wire-side connector provided on a wire side and to be connected to the device-side connector, wherein the device-side connector includes a device-side receptacle group formed by stacking a plurality of device-side receptacles having an opening on a front side in a connecting direction;

the wire-side connector includes a plurality of wire-side terminals, a plurality of terminal accommodating portions configured to respectively accommodate the wire-side terminals and to be individually accommodated into the device-side receptacles when the device-side connector and the wire-side connector are connected, and an accommodation case configured to hold the plurality of terminal accommodating portions movably in a direction intersecting with the connecting direction;

the opening of an end device-side receptacle arranged on one end part out of the plurality of device-side receptacles includes a guiding protrusion projecting in a stacking direction and configured to guide the corresponding terminal accommodating portion in a proper connection posture into the end device-side receptacle, whereas the accommodation case includes a receiving portion configured to receive the guiding protrusion;

the end device-side receptacle includes a guide groove configured to guide the terminal accommodating portion guided by the guiding protrusion into the device-side receptacle, whereas the corresponding terminal accommodating portion includes a guide protrusion formed to project in an outward direction from a wall portion constituting the terminal accommodating portion and to be guided by the guide groove of the end device-side receptacle; and each of the plurality of device-side receptacles includes a guiding portion configured to guide the terminal accommodating portion in a proper connection posture into the corresponding device-side receptacle, whereas each of the plurality of terminal accommodating portions includes a guided portion to be guided by the guiding portion of the device-side receptacle.

3. A connector, comprising:

a wire-side connector having an accommodation case with opposite front and rear ends spaced apart along a connecting direction and opposite first and second side walls spaced apart along a stacking direction that is perpendicular to the connecting direction, a plurality of terminal accommodating portions arranged in the stacking direction between the first and second side walls of the accommodation case and being movable relative to the accommodation case in directions transverse to the connecting direction, a receiving portion disposed at a first side of the accommodation case in the stacking direction and being open at the front end of the accommodation case, at least a first of the terminal accommodating portions in the stacking direction including a guided portion; and a device-side connector having a front end that is connectable to the wire side connector along the connecting direction, the device-side connector including a receptacle group formed by stacking receptacles in the stacking direction, the receptacles having openings at the front end of the device-side connector and configured to receive the terminal accommodating portions of the wire-side connector, a first of the receptacles at a first side of the receptacle group in the stacking direction including a guiding protrusion projecting out in the stacking direction and being received in the receiving portion of the accommodation case to guide an opposed one of the terminal accommodating portions in a proper connection posture into the first receptacle, the guiding protrusion including an inclined surface that is inclined relative to the connecting direction, a guide groove extending from the inclined surface and receiving the guided portion of the first terminal accommodating portion to guide the terminal accommodating portion.

4. The connector of claim 3, wherein each of the terminal accommodating portions includes one of the guided portions and each of the receptacles includes one of the guide grooves, the guide grooves receiving the respective guided portions for guiding the wire-side connector into connection with the device side connector.

* * * * *